US005499813A

United States Patent [19]

Black

[11] Patent Number: 5,499,813

[45] Date of Patent: Mar. 19, 1996

[54] GOLF BALL TEEING DEVICE

[76] Inventor: Joseph Black, 68 Bathurst St., Toronto, Ontario, Canada, M5V 2P5

[21] Appl. No.: 406,489

[22] Filed: Mar. 20, 1995

[51] Int. Cl.[6] ..... A63B 57/00

[52] U.S. Cl. ..... 273/32.5

[58] Field of Search ..... 273/232.5, 32 F, 273/32 B, 33, 162 E, 162 F; 294/119.1, 119.2

[56] References Cited

U.S. PATENT DOCUMENTS

| | | | |
|---|---|---|---|
| 2,609,198 | 9/1952 | Armstrong | 273/32.5 |
| 3,206,197 | 9/1965 | Miotke | 273/32.5 |
| 4,951,947 | 8/1990 | Kopfle | 273/32.5 |
| 4,969,646 | 11/1990 | Tobias | 273/32.5 |
| 5,330,178 | 7/1994 | Geishert, Sr. | 273/32.5 |
| 5,407,194 | 4/1995 | Snow | 273/32.5 |
| 5,439,213 | 8/1995 | Pimentel | 273/32.5 |

*Primary Examiner*—V. Miller

*Assistant Examiner*—Steven B. Wong

*Attorney, Agent, or Firm*—Oltman and Flynn

[57] ABSTRACT

According to the invention there is provided a golf ball teeing device comprising a forwardly open receiver for receiving a golf ball, the receiver having a back panel, a top panel, a bottom panel, and two side panels, the side panels diverging in forward direction a given angle A, the bottom panel having a slot rearwardly extending from a forward edge of the bottom panel wherein the slot is tapered inward a given angle B for receiving a stem of a tee with the head of the tee disposed in the receiver, wherein the angle B is smaller than the angle A; a tubular shaft extends upward from the top panel, a push rod is slidably disposed in the shaft, the push rod having a bottom end extending through the top panel for clamping a golf ball against the head of the tee and a top end extending above an upper end of the shaft for receiving a clamping force applied to the top end of the shaft, further including a handle attached to the upper end of the shaft, the handle including a button attached to the upper end of the push rod for applying the clamping force.

10 Claims, 2 Drawing Sheets

GOLF BALL TEEING DEVICE

The invention relates to a golf ball teeing device which has a forwardly open receiver having an interior for receiving a golf ball, the receiver having a plurality of panels defining the interior including a bottom panel, the bottom panel having a slot rearwardly extending from a forward edge of the bottom panel, wherein the slot is tapered inward a given angle for receiving a stem of a tee with the head of the tee disposed in the receiver.

BACKGROUND AND PRIOR ART

For many golf players, before teeing off it is difficult to bend down and place a tee in the ground and place a golf ball on the tee due to difficulties with a back or knees. For lady golfers it is also often uncomfortable to bend down and tee a ball surrounded by other players.

To this end inventors have devised implements for teeing a ball without the need for bending down. For the same players it is also often difficult to retrieve a ball from a cup or from an inaccessible location.

The following prior art is known to applicant:

U.S. Pat. No. 5,330,178 shows a golf ball and tee positioning apparatus which, however, does not have applicant's enclosed receiver. U.S. Pat. No. 4,951,947 is a teeing device having an enclosed receiver, but having the drawback that the ball can easily get knocked off the tee as the receiver is withdrawn. U.S. Pat. No. 2,609,198 shows a teeing device with an enclosed receiver, but it does not have applicant's particularly structured receiver and guide slot for the tee stem which operate to prevent knocking off the ball as the receiver is withdrawn.

It is accordingly the object of the invention to provide a teeing device that does not have the drawbacks of the known devices, and provide a teeing device that is easy to use, and has other advantages as will become apparent from a reading of the following disclosure.

Further objects and advantages of this invention will be apparent from the following detailed description of a presently preferred embodiment which is illustrated schematically in the accompanying drawings.

SUMMARY OF THE INVENTION

According to the invention there is provided a golf ball teeing device comprising a forwardly open receiver for receiving a golf ball, the receiver having a back panel, a top panel, a bottom PANEL and two side panels, the side panels diverging in forward direction a given angle A, the bottom panel having a slot rearwarding extending from a forward edge of the bottom panel wherein the slot is tapered inward a given angle B for receiving a stem of a tee with the head of the tee disposed in the receiver, wherein the angle B is smaller than the angle A; a tubular shaft extends upward from the top panel, a push rod is slidably disposed in the shaft, the push rod having a bottom end extending through the top panel for clamping a golf ball against the head of the tee and a top end extending above an upper end of the shaft for receiving a clamping force applied to the top end of the shaft, further including a handle attached to the upper end of the shaft, the handle including a button attached to the upper end of the push rod for applying the clamping force.

According to a further feature the golf ball teeing device includes a spring arrangement for spring biasing the push rod away from the top panel, and a ground spike pivotally attached to the receiver, the ground spike having an extended position in which the ground spike is pointing away from the receiver, and a folded position in which the ground spike is folded upward against receiver. The spring arrangement advantageously includes a coil spring disposed between the button and the handle.

The golf ball teeing device may further have holes in the handle for storing tees.

According to a further feature the golf ball teeing device has a bottom end of the push rod with a disk for engaging the golf ball.

In addition, in the golf ball teeing device the disk has a lower surface being upwardly curved to match a curvature of the ball.

In addition, the golf ball teeing device may further include a short shaft pivotally attached to the shaft, the pivot arm having a distal end, and a suction cup on the distal end for rasping a golf ball.

DESCRIPTION OF THE PREFERRED EMBODIMENTS

Figure 1:
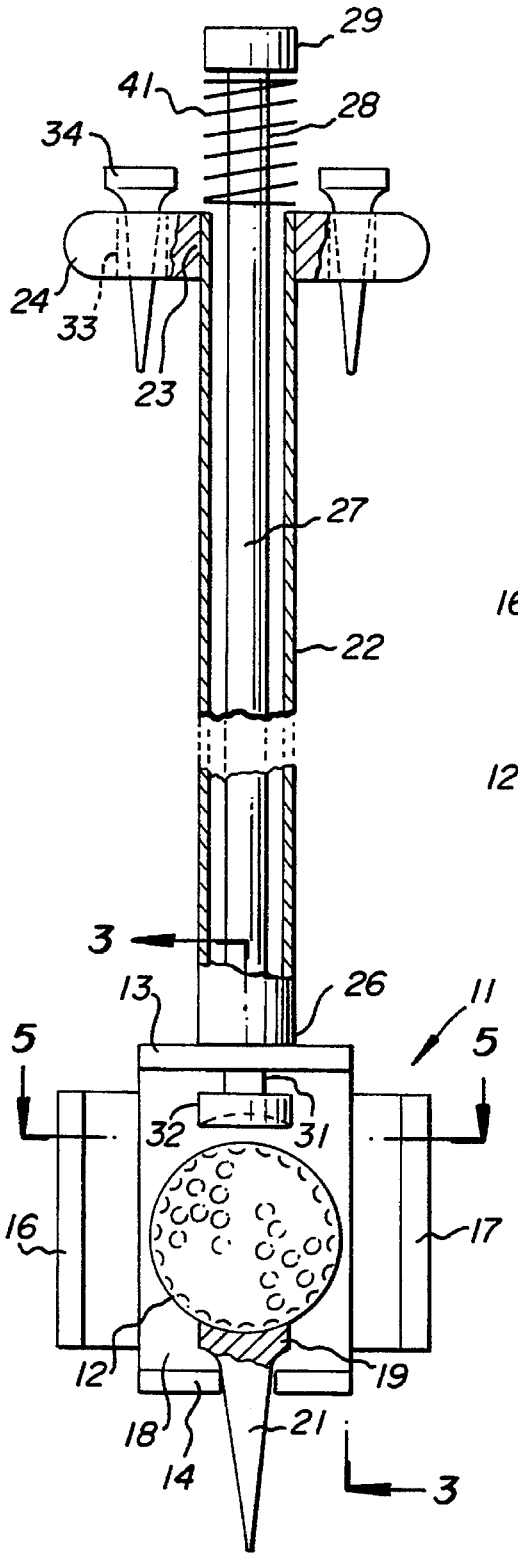
FIG. 1 is an elevational, part cross-sectional view showing a front view of the invention.
Figure 2:
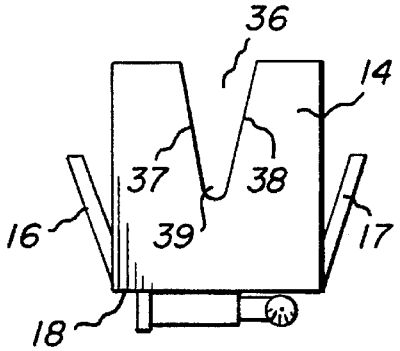
FIG. 2 is a bottom view of the invention.
Figure 3:
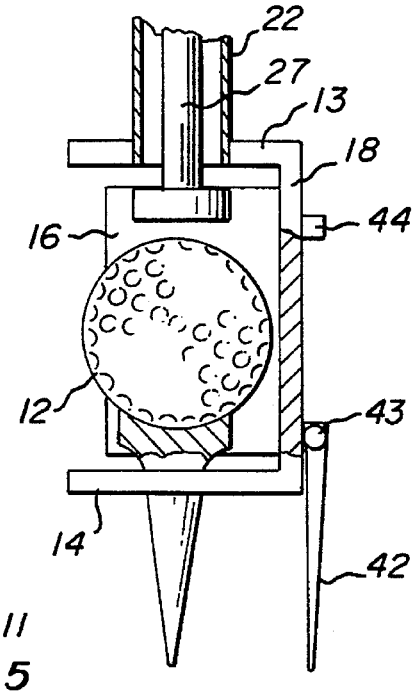
FIG. 3 is a fragmentary, elevational view showing a side view of the receiver part of the invention.
Figure 4:
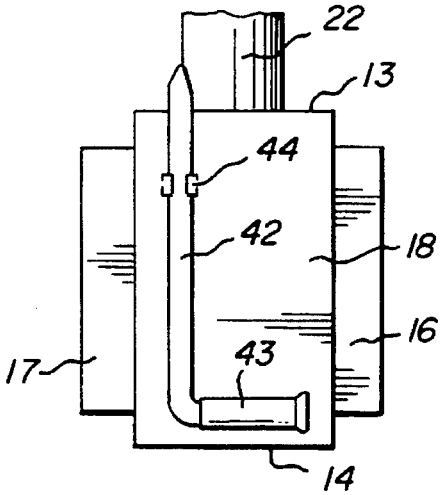
FIG. 4 is a fragmentary, elevational view showing a rear view of the receiver part of the invention.

In FIG. 1 a receiver for receiving a golf ball 12 is seen from the front, showing an interior space for receiving the golf ball 12. The interior space is bounded by a top panel 13, a bottom panel 14 and two side panels 16, 17, and a back panel 18. FIGS. 2, 3 and 4 are respective bottom, side and rear views of the same receiver, wherein FIG. 3 is seen along the line 3—3 of FIG. 1.

The golf ball 12 is shown seated on the head 19 of a golf tee stem 21. The head 19 has a slightly concave top surface which allows a golf ball to be seated therein.

A tubular shaft 22 extends upward from the top panel 13 of the receiver 11 to a certain distance so that the device can be conveniently operated by a player. The shaft 22 has at its upper end 23 an elongated handle 24 disposed perpendicular to the shaft 22. The bottom end 26 of the shaft 22 is rigidly attached to the top panel 13. An axially slidable push rod 27 is positioned inside the tubular shaft 22, and has an upper end 28 extending upward through the handle 24 and is terminated with a flat button or disk 29.

The bottom end 31 extends downward through a hole in the top panel 13 and is terminated in a disk 32, having an upwardly curved surface matching the curvature of the golf ball 12.

The handle 24 may advantageously have storage holes 33 for storing spare tees 34.

Figure 5:
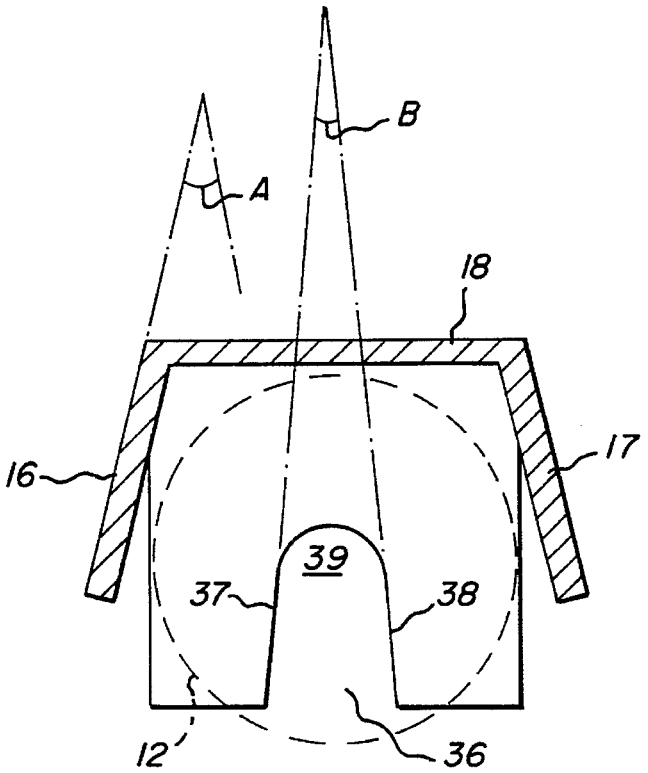
FIG. 5 is a cross-sectional view of the receiver seen along lines 5—5 of FIG. 1.

The bottom panel 14 has, as seen in FIG. 2 and 5, a V-shaped slot 36 having inward tapered sides 37,38, tapering to a bottom 39, adapted to receive the upper part of the stem 21 of the tee head 19.

In operation a player who wishes to set a tee without having to bend down, places a ball 12 in the interior of receiver 11, and a tee with the head 19 and the stem 21 in the V-shaped slot 36, as seen in FIG. 1. Next, he grasps the handle 24, and with the palm of the grasping hand, pushes down the push rod 27, against the spring pressure of a coil spring 41, so that the golf ball 12 is seated firmly clamped against the tee head 19. With the ball still clamped in place he inserts the stem 21 of the tee into the ground, releases the push rod 27 and removes the receiver 11 by drawing it backward away from the tee.

As seen in FIG. 5, the V-shaped slot 36 has its sides 37, 38 tapered at an angle B, while side panels 16, 17 diverge to form an angle A, which is greater than angle B. As a result, as the player withdraws the receiver, there is no risk of knocking the ball off the head of the tee, since the position of the receiver is controlled by the width of the V-shaped slot 38. Since the angle B of the taper of slot 38 is less than the angle A of the divergence of side panels 16, 17, it is impossible to knock off the ball during the withdrawal.

Figure 8:
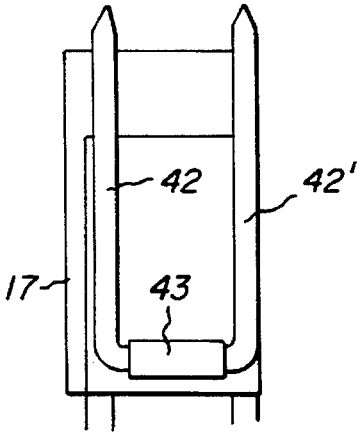
FIG. 8 shows a double-pronged spike.

After withdrawal, the player may wish to set aside the teeing device, without having to bend down and pick it up again. To that end a pivotable spike 42 is normally stored in folded position as shown in FIG. 4 with the spike 42 pointing upward. After having set the tee, the player pivots down the spike as seen in FIG. 3 and drives it into the ground so the teeing device remains standing upright. After use, the spike 42 is pivoted up about the pivot sleeve 43, and snapped into its folded position, held in place by a snap spring 44, attached to back panel 18. Instead of a single spike, the spike may be shaped as a letter "U", as seen in FIG. 8, with two pointed legs 42, 42' that can be driven into the ground for better staying power.

Figure 7:
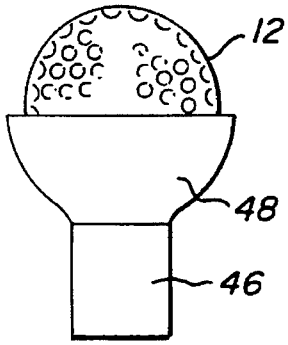
FIG. 7 shows a golf ball in a suction cup.
Figure 6:
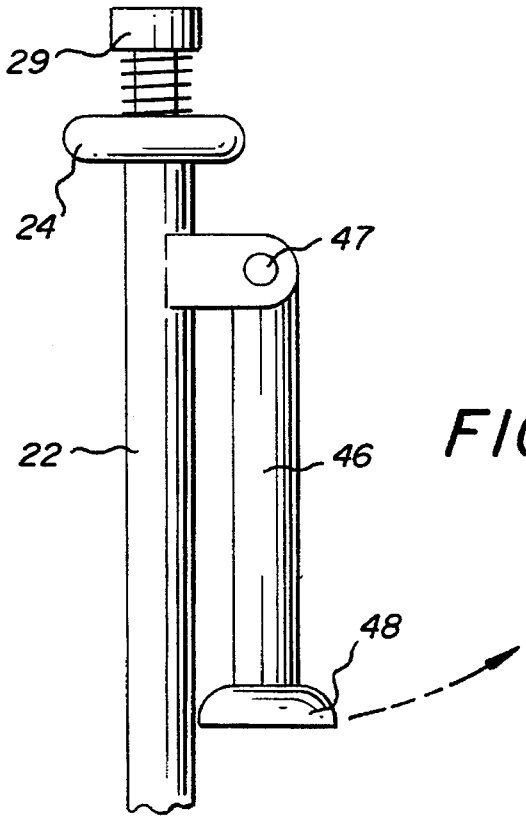
FIG. 6 is a fragmentary, elevational view showing a swing arm with a suction cup for picking up golf balls.

FIG. 6 shows an additional feature, which includes a short pivotable shaft 46, pivotably attached at one end at pivot point 47 to the upper end of shaft 22. The short shaft 46 has at its other end a suction cup 48 which operates to retrieve golf balls, e.g. from a hole or to pick it up from locations where it cannot be reached with a golf club. FIG. 7 is a fragmentary view of the suction cup mounted on the end of the short shaft 46.

I claim:

1. A golf ball teeing device comprising a forwardly open receiver for receiving a golf ball, said receiver having a back panel, a top panel, a bottom panel, and two side panels, said side panels diverging in forward direction at a given angle A, the bottom panel having a slot rearwardly extending from a forward edge of said bottom panel wherein the slot is tapered inward at a given angle B for receiving a stem of a tee with the head of the tee disposed in said receiver, wherein the angle B is smaller than the angle A; a tubular shaft extending upward from said top panel, a push rod slidably disposed in said shaft, said push rod having a bottom end extending through said top panel for clamping a golf ball against the head of the tee and a top end extending above an upper end of said shaft for receiving a clamping force applied to the top end of said shaft.

2. A golf ball teeing device according to claim 1, including a handle attached to the upper end of said shaft.

3. A golf ball teeing device according to claim 2, including a button attached to the upper end of said push rod for receiving the clamping force.

4. A golf ball teeing device according to claim 3, including spring means for spring biasing said push rod away from said top panel.

5. A golf ball teeing device according to claim 1, including at least one ground spike pivotally attached to said receiver, said ground spike having an extended position in which said ground spike is pointing away from said housing, and a folded position in which said ground spike is folded upward against said housing.

6. A golf ball teeing device according to claim 4, wherein said spring means include a coil spring disposed between said button and said handle.

7. A golf ball teeing device according to claim 2, having holes in said handle for storing tees.

8. A golf ball teeing device according to claim 1, wherein the bottom end of said push rod has a disk for engaging the golf ball.

9. A golf ball teeing device according to claim 8, wherein said disk has a lower surface being upwardly curved to match a curvature of the ball.

10. A golf ball teeing device according to claim 1, including a short shaft pivotally attached to said shaft, said pivot arm having a distal end, and a suction cup on said distal end for grasping a golf ball.

* * * * *